US012044153B1

(12) United States Patent
Byrum

(10) Patent No.: US 12,044,153 B1
(45) Date of Patent: Jul. 23, 2024

(54) OIL SAFETY CAP SYSTEM

(71) Applicant: Lyle Byrum, El Paso, TX (US)

(72) Inventor: Lyle Byrum, El Paso, TX (US)

( * ) Notice: Subject to any disclaimer, the term of this patent is extended or adjusted under 35 U.S.C. 154(b) by 0 days.

(21) Appl. No.: 18/234,729

(22) Filed: Aug. 16, 2023

(51) Int. Cl.
*F01M 11/04* (2006.01)

(52) U.S. Cl.
CPC ..... *F01M 11/04* (2013.01); *F01M 2011/0491* (2013.01)

(58) Field of Classification Search
CPC . F16N 21/06; F16N 19/00; F01M 2011/0491; F01M 11/04
USPC ..... 184/1.5, 88.1, 105.1
See application file for complete search history.

(56) References Cited

U.S. PATENT DOCUMENTS 978,521 A * 12/1910 Wahlstrom ..... F16N 21/06 184/91
1,308,331 A * 7/1919 Brown ..... F16N 21/06 184/91
1,311,327 A * 7/1919 Devlin ..... F16N 21/06 184/91
1,363,812 A * 12/1920 Pribil ..... F16N 21/06 184/91
2,297,850 A * 10/1942 Woolery ..... G01F 23/04 33/727
3,474,884 A * 10/1969 Braun ..... F16N 19/003 184/6.4
3,662,470 A * 5/1972 Sasgen ..... G01F 23/04 33/731
3,990,489 A * 11/1976 Ruter ..... F01M 11/04 141/330
4,091,894 A * 5/1978 Lang ..... G01F 23/02 184/105.1
4,286,727 A * 9/1981 Limoncelli ..... F16N 21/06 220/817
4,338,983 A * 7/1982 Hatcher ..... B67C 11/02 141/331
4,497,419 A * 2/1985 Reitzel ..... B65D 39/10 220/295
4,509,567 A * 4/1985 Harrison ..... F16N 21/06 184/88.1
4,640,126 A * 2/1987 Jansch ..... G01F 23/04 33/723
4,703,867 A * 11/1987 Schoenhard ..... F01M 11/04 141/331

(Continued)

FOREIGN PATENT DOCUMENTS

CN 107191243 9/2017
CN 109209706 1/2019
DE 102008004084 7/2009

*Primary Examiner* — Henry Y Liu

(57) ABSTRACT

An oil safety cap system for jet engines includes a safety cap that fits over an oil cap and an oil fill spout. The safety cap is attached to a locking pin. The safety cap also has a first locking pin aperture that extends through the safety cap to receive the locking pin. An attachment mechanism secures the safety cap over the oil cap and the oil fill spout. The attachment mechanism includes a first clamp half removably attached to a second clamp half. The first and second clamp halves extend around the oil fill spout, beneath the safety cap. A second locking pin aperture in the second clamp half also receives the locking pin. The locking pin apertures align when the safety cap is positioned on the oil fill spout. The looking pin extends through both apertures and secures the safety cap to the attachment mechanism.

13 Claims, 6 Drawing Sheets

(56) References Cited

U.S. PATENT DOCUMENTS

| | | | | | |
|---|---|---|---|---|---|
| 5,373,957 | A * | 12/1994 | Gryc | B60K 15/04 | 220/86.1 |
| 5,554,419 | A * | 9/1996 | Chung | G02F 1/133711 | 349/123 |
| 6,009,920 | A * | 1/2000 | Palvoelgyi | B60K 15/04 | 141/59 |
| 6,073,618 | A * | 6/2000 | Sanders | F01M 13/00 | 123/196 CP |
| 7,678,169 | B1 * | 3/2010 | Gwin | B01D 45/06 | 123/41.86 |
| 8,042,705 | B2 * | 10/2011 | Ligorio | F01M 11/04 | 220/254.1 |
| 9,371,743 | B2 * | 6/2016 | Snyder | F01D 25/18 | |
| 10,208,648 | B1 * | 2/2019 | Cooper | F01P 7/14 | |
| 2004/0065512 | A1 * | 4/2004 | Gates | F01M 11/12 | 184/88.1 |
| 2006/0249117 | A1 * | 11/2006 | Davis | F02M 17/40 | 261/DIG. 8 |
| 2008/0135553 | A1 * | 6/2008 | Ligorio | G01F 23/04 | 220/203.23 |
| 2010/0187232 | A1 * | 7/2010 | Fogle | F01M 11/0408 | 220/210 |
| 2014/0231437 | A1 * | 8/2014 | Snyder | F01D 25/00 | 49/506 |

* cited by examiner

OIL SAFETY CAP SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to caps for securely closing an engine oil tank and more particularly pertains to a new safety cap for securely closing an engine oil tank for jet engines.

(2) Description of Related Art Including Information Disclosed Under 37 CFR 1.97 and 1.98

The prior art relates to caps for securely closing an engine oil tank. Some jet engines, such as the Pratt & Whitney 305a and 305b engines, use an over center spring lock cap without any positive locking devices. It is therefore possible that vibration from the engine could either break the spring or cause it to open. Some such jets include an engine vibration monitor which displays a warning light in the cockpit of the aircraft when a vibration limit is exceeded. However, such safety devices are ineffective in ensuring the oil cap is firmly secured before takeoff. When an oil cap is not firmly secured, the engine oil pressure will fluctuate, and can even be lost, damaging the aircraft and risking lives. Thus, there is a need in the art for a safety cap that will lock the oil cap in place within the engine.

BRIEF SUMMARY OF THE INVENTION

An embodiment of the disclosure meets the needs presented above by generally comprising an oil safety cap that fits over an oil cap and at least a portion of an oil fill spout of an engine. The oil safety cap is attached to a locking pin. The oil safety cap also has a first locking pin aperture that extends through the oil safety cap and that can receive the locking pin. An attachment mechanism secures the oil safety cap over the oil cap and the oil fill spout. The attachment mechanism includes a first clamp half removably attached to a second clamp half. The first and second clamp halves extend around the circumference of the oil fill spout, beneath the oil safety cap. The second clamp half has a second locking pin aperture that can receive the locking pin. The first and second locking pin apertures align when the oil safety cap is positioned on the oil fill spout, so that the looking pin extends through both apertures, whereby the locking pin secures the safety cap to the attachment mechanism.

There has thus been outlined, rather broadly, the more important features of the disclosure in order that the detailed description thereof that follows may be better understood, and in order that the present contribution to the art may be better appreciated. There are additional features of the disclosure that will be described hereinafter, and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
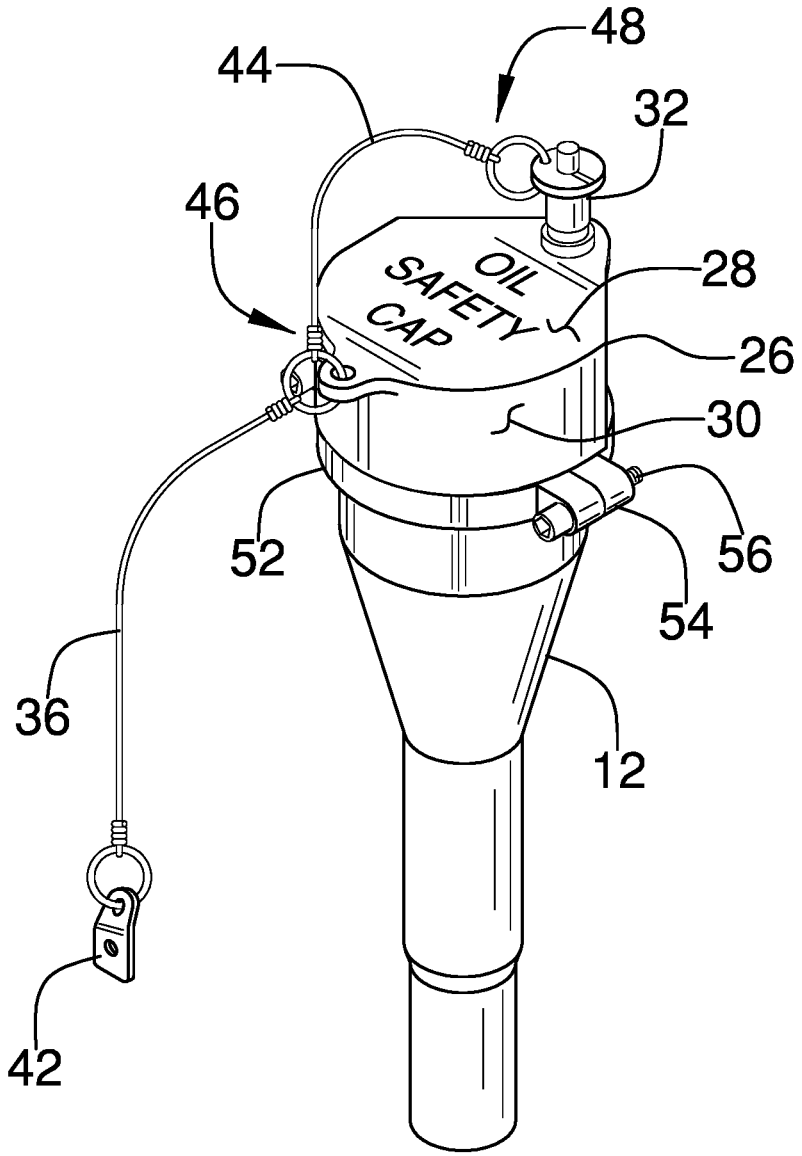
FIG. 1 is a front isometric view of an oil safety cap system according to an embodiment of the disclosure.
Figure 2:
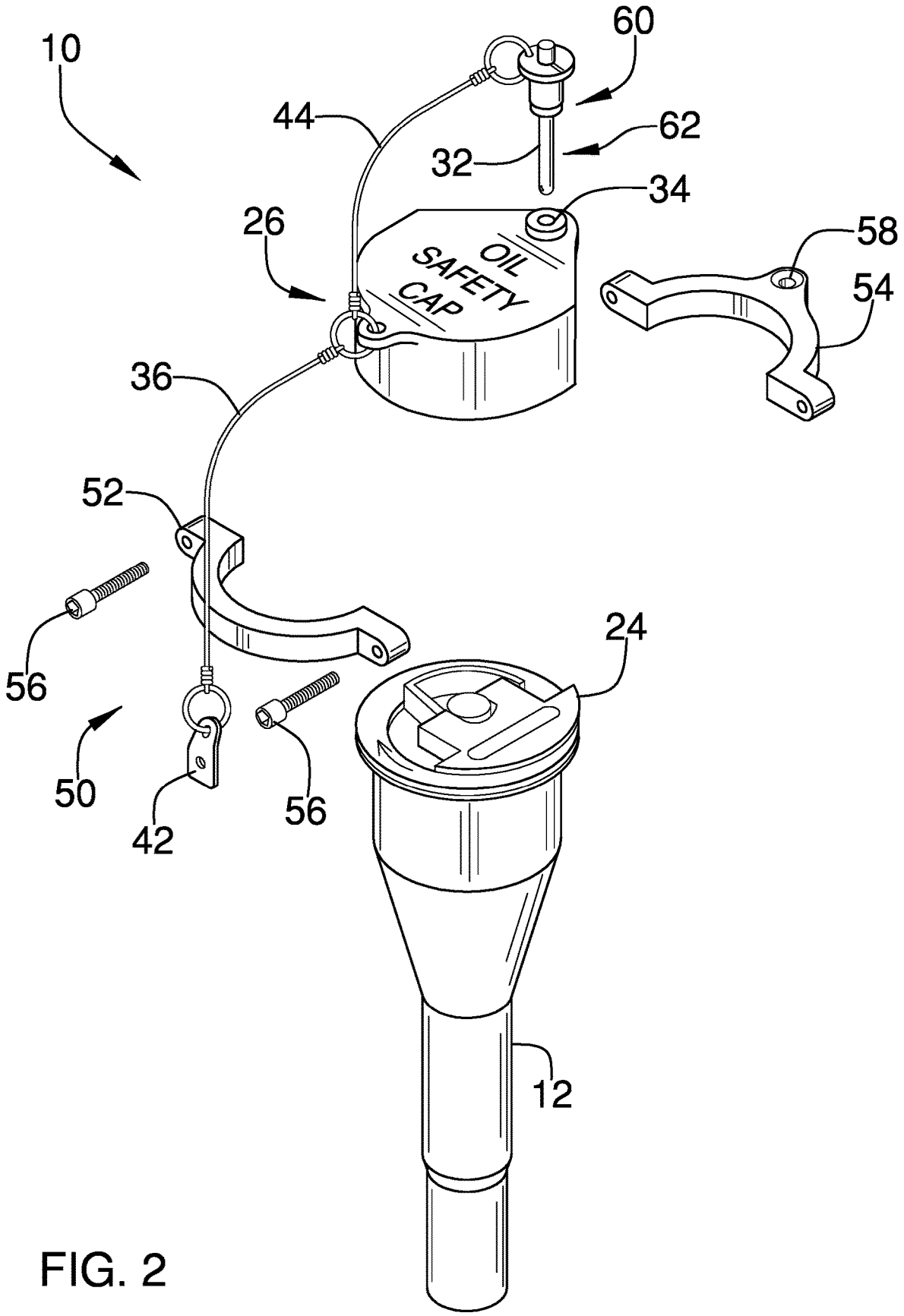
FIG. 2 is an exploded view of an embodiment of the disclosure.

With reference now to the drawings, and in particular to FIGS. 1 through 8 thereof, a new cap for securely closing an engine oil tank embodying the principles and concepts of an embodiment of the disclosure and generally designated by the reference numeral 10 will be described.

As best illustrated in FIGS. 1 through 8, the oil safety cap system 10 generally comprises an oil fill spout 12 is housed within an oil tank 14 of a jet engine 16. The oil tank 14 has an access door 18 opening and closing across a doorway 20. The access door 18 permits access to the oil fill spout 12 when the access door 18 is open. The access door 18 restricts access to the oil fill spout 12 when the access door 18 is closed. A door pin 22 is attached to the access door 18. The door pin 22 generally extends outwardly from the access door 18. The oil fill spout 12 has an opening therein and an oil cap 24 is configured to cover the opening.

Figure 3:
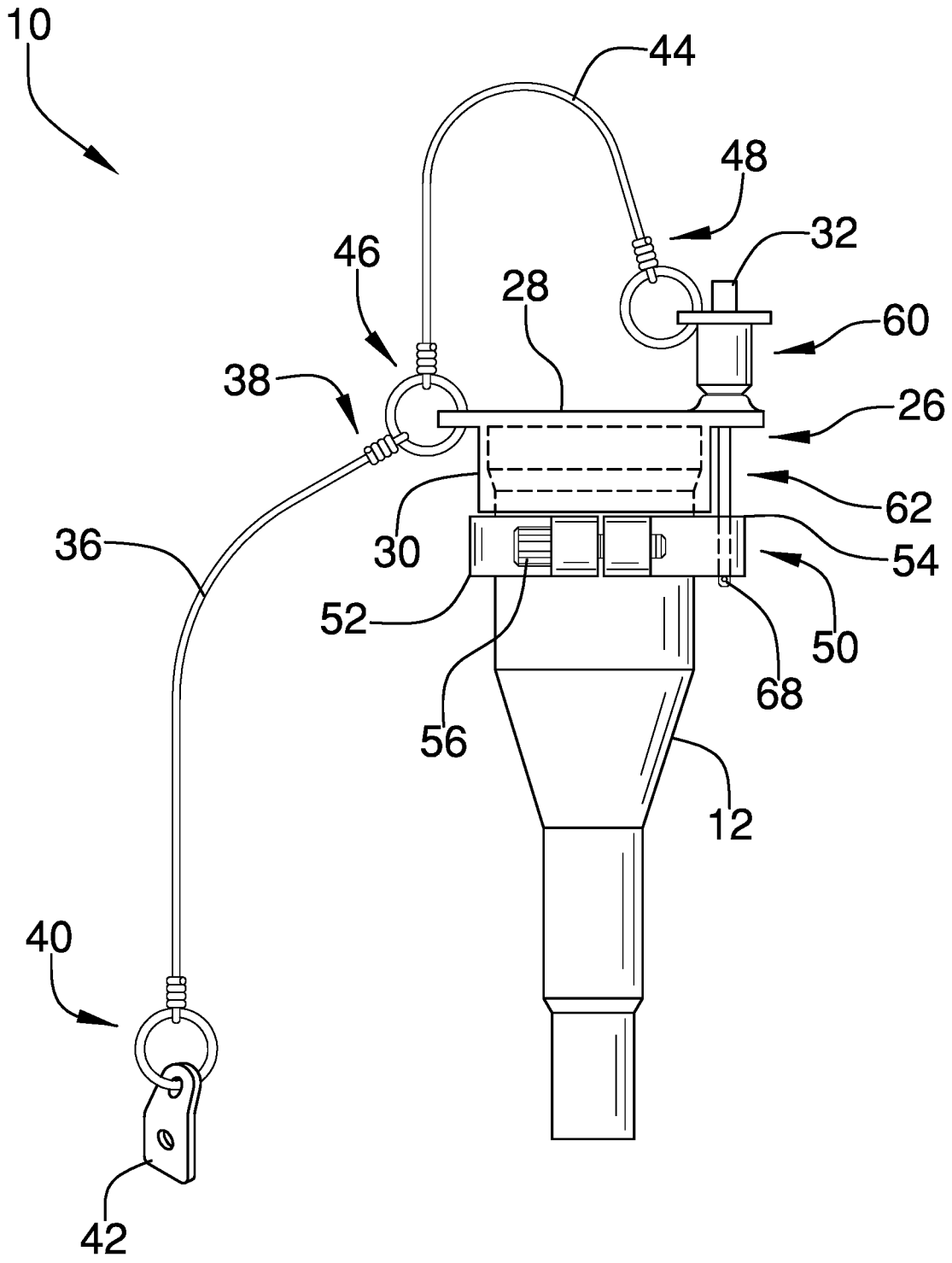
FIG. 3 is an assembled side view of an embodiment of the disclosure.
Figure 4:
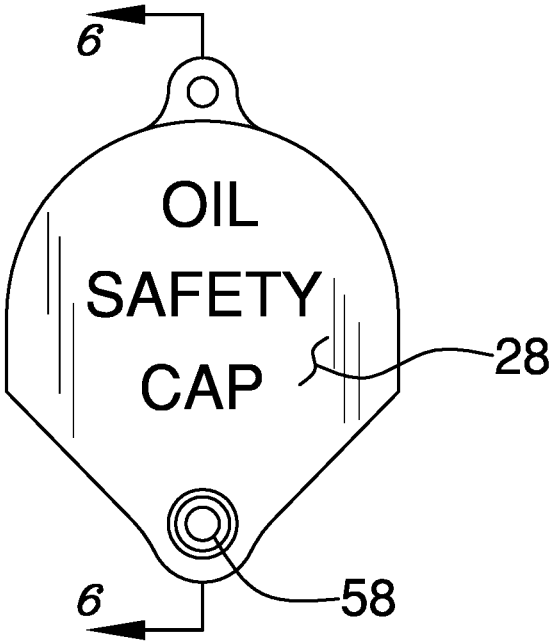
FIG. 4 is a top view of an embodiment of the disclosure.
Figure 5:
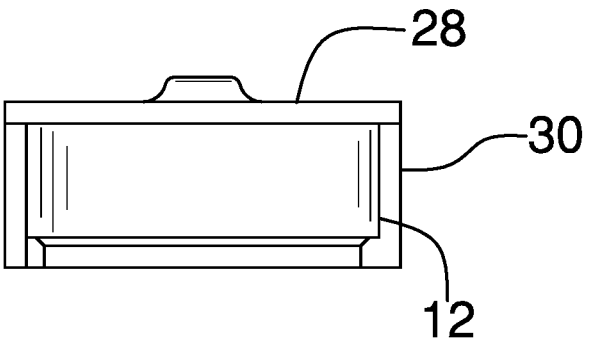
FIG. 5 is a side view of an embodiment of the disclosure.
Figure 6:
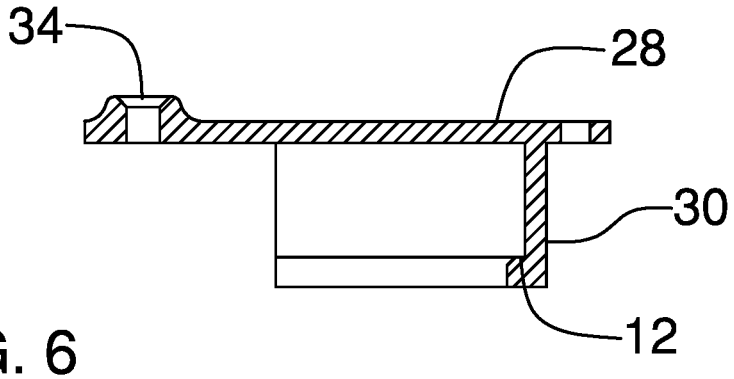
FIG. 6 is a cross-sectional view of an embodiment of the disclosure.
Figure 7:
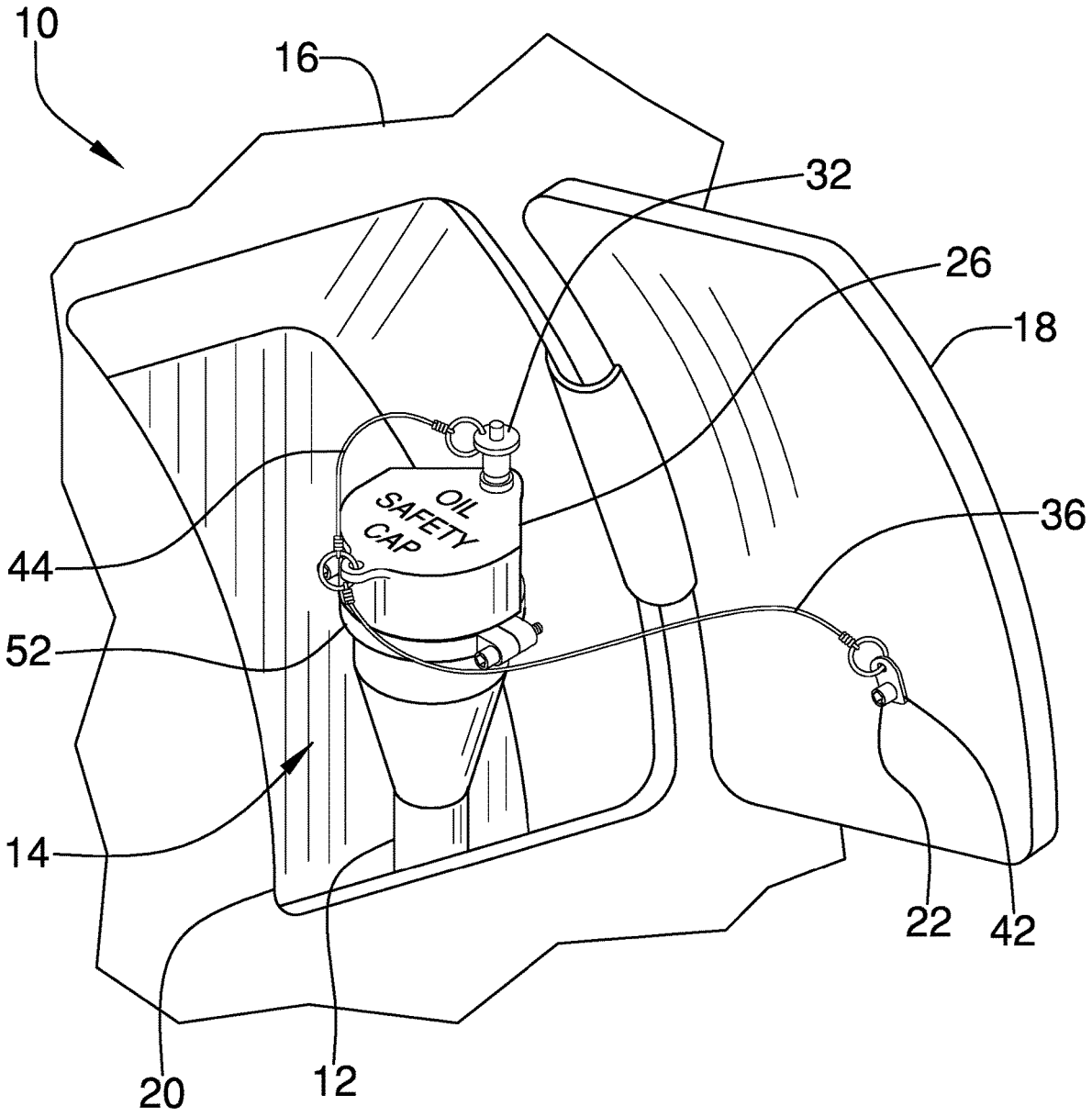
FIG. 7 is an in-use view of an embodiment of the disclosure.
Figure 8:
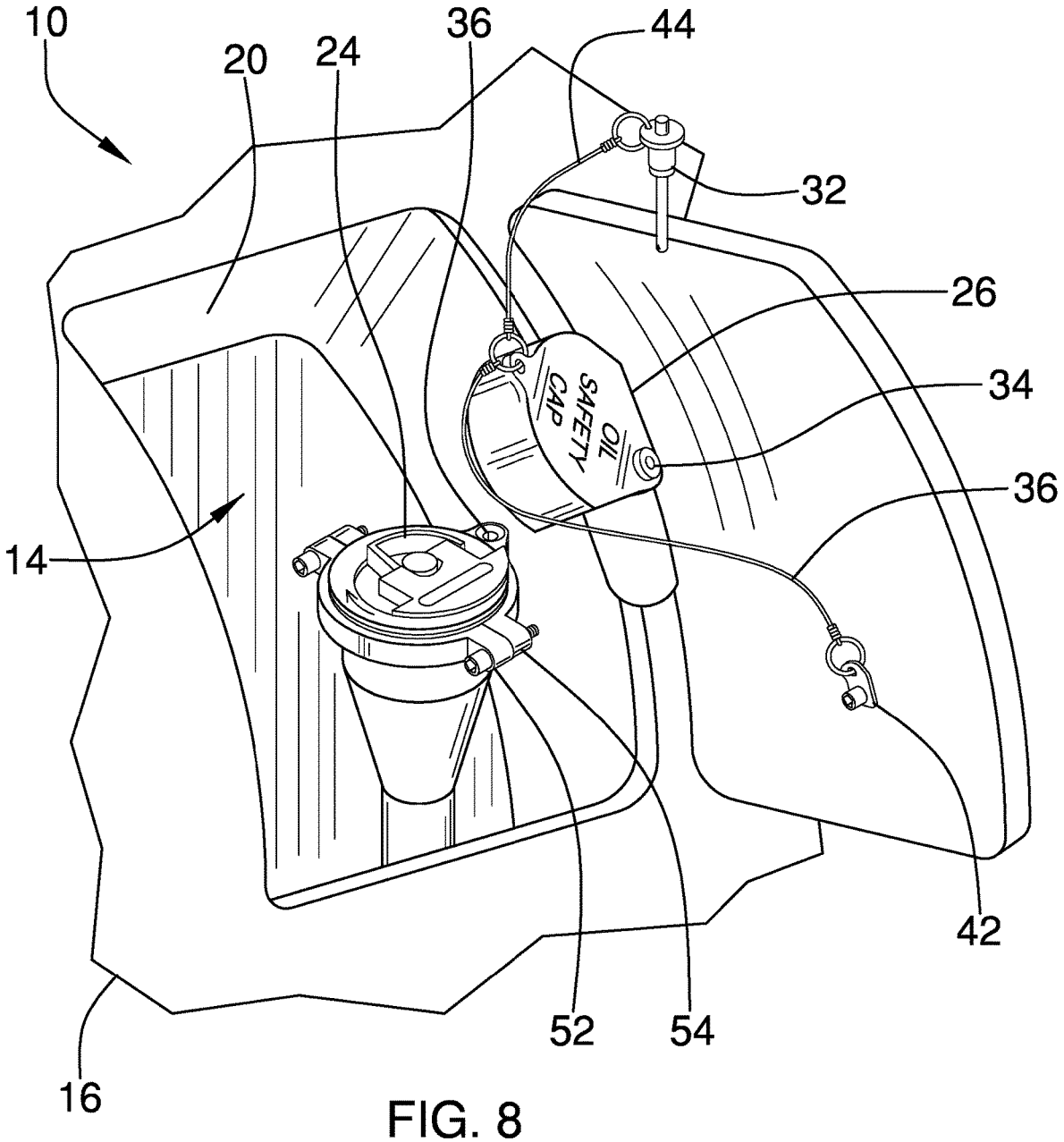
FIG. 8 is an in-use view of an embodiment of the disclosure.

A safety cap 26 is configured to secure the oil cap 24 over the opening of the oil fill spout 12. The safety cap 26 has a top panel 28 and a perimeter wall 30. The perimeter wall 30 is attached to and extends downwardly from the top panel 26. The safety cap 26 fits over the oil cap 24 and at least a portion of the oil fill spout 12. A locking pin 32 is attached to the safety cap 26. The top panel 28 has a first locking pin aperture 34 extending therethrough. For example, as shown in FIG. 3, the top panel 28 may extend outwardly from the perimeter wall 30. In such embodiments, the locking pin aperture 34 is opposite the perimeter wall 30 from the oil fill spout 12 when the safety cap 26 is placed over the oil fill spout 12. The first locking pin aperture 34 is configured to receive the locking pin 32. The locking pin 32 should fit firmly and securely within the first locking pin aperture 34, allowing gravity and friction to retain the locking pin 32 in place.

A door lanyard 36 has a cap section 38 and a door section 40. The cap section 38 is attached to the safety cap 26. A door tab 42 is attached to the door section 40. The door tab 42 can be releasably coupled to the door pin 22. The door lanyard 36 secures the safety cap 26 to the oil tank 14 so that the safety cap 26 is not lost, misplaced, or forgotten, for example when the oil is being changed or other maintenance is being performed on the aircraft.

A locking pin lanyard 44 is attached to the safety cap 26. The locking pin lanyard 44 has a first portion 46 and a second portion 48. The first portion 46 is attached to the safety cap 26. The locking pin 32 is secured to the second portion 48. The locking pin lanyard 44 ensures that the locking pin 32 remains connected to the safety cap 26 even when the safety cap 26 is removed from over the oil cap 24 and the oil fill spout 12.

An attachment mechanism 50 is attached to the oil fill spout 12. The attachment mechanism 50 is generally configured to secure the safety cap 26 over the oil fill spout 12 and the oil cap 24. The attachment mechanism 50 generally comprises a first clamp half 52 and a second clamp half 54 that are configured to extend around a circumference of the oil fill spout 12. The first clamp half 52 and the second clamp half 54 are laterally displaced with respect to one another across the oil fill spout 12.

A pair of clamp screws 56 is inserted through the first clamp half 52 and the second clamp half 54. The pair of clamp screws 56 are configured to securely attach the first clamp half 52 to the second clamp half 54 around the oil fill spout 12. The pair of clamp screws 56 are laterally displaced with respect to each other across the first 52 and second clamp halves 56.

The second clamp half 56 has a second locking pin aperture 58 extending therethrough. The second locking pin aperture 58 is configured to receive the locking pin 32. Said first locking pin aperture 34 and the second locking pin aperture 58 are alignable when the safety cap 26 is positioned on the oil fill spout 12 so that the locking pin 32 is extendable through both of the first 34 and the second 58 locking pin apertures. The locking pin 32 is configured to be firmly positioned within the first 34 and the second 58 locking pin apertures, whereby the locking pin 32 secures the safety cap 26 to the attachment mechanism 50. With a sufficiently firm and tight fit, gravity and friction should retain the locking pin 32 in place within each of the first 34 and second 58 locking pin apertures.

Some embodiments will include further elements to improve the retention of the locking pin 32 in place within the first 34 and second 58 locking pin apertures. In one such embodiment, the locking pin 32 has a top portion 60 and a bottom portion 62. The top portion 60 has a top diameter 64 and the bottom portion 62 has a bottom diameter 66. Generally, the top diameter 64 is larger than the bottom diameter 66. The bottom diameter 66 is configured to fit within the first 34 and the second 58 locking pin apertures, while the top diameter 64 is generally too large to fit within the first 34 and second 58 locking pin apertures. A pair of spring-loaded ball bearings 68 are laterally displaced across the bottom portion 62. The locking pin 32 can extend through the first 34 and second 58 locking pin apertures. The top portion 60 extends upwardly from the first locking pin aperture 34 and the bottom portion 62 extends downwardly from the second locking pin aperture 58 such that each of the pair of spring-loaded ball bearings 68 is below the second clamp half 54 and a tension on the pair of spring-loaded ball bearings 68 is released to secure the position of the locking pin 32 within the first 34 and second 58 locking pin apertures. If the spring-loaded ball bearings 68 fail, gravity and friction will keep the locking pin 32 in place.

In use, the safety cap 26 can be removed from the oil fill spout 12 by removing the locking pin 32 from the first 34 and second 58 locking pin apertures. Once removed, the safety cap 26 can hang from the access door 18 via the door lanyard 36, which is attached to the door pin 22. The oil cap 24 can be removed from the oil fill spout 12 to check the oil levels, refill the oil tank 14, or perform other maintenance on the jet engine 16. The attachment mechanism 50 can generally remain in place without obscuring access to the oil fill spout 12. One maintenance is finished, the oil cap 24 can be placed back onto the oil fill spout 12 and the safety cap 26 can be placed over the top. The safety cap 26 should fit tightly over the oil fill spout 12, physically contacting, or nearly physically contacting, the attachment mechanism 50. Because the door lanyard 36 is attached to the access door 18, the safety cap 26 remains within, or near to, the oil tank 14. In some embodiments, the door lanyard 36 is long enough to extend down past the bottom edge of the access door 18, such that the door lanyard 18 sticks between the access door 18 and the doorway 20, preventing the access door 18 from closing completely over the doorway 20 until the safety cap 26 is replaced over the oil fill spout 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An oil safety cap system comprising:

an oil fill spout;

an oil cap, the oil cap covering an opening within the oil fill spout, the oil fill spout being housed within an oil tank of a jet engine;

a doorway being positioned on the jet engine, the doorway being configured to permit access to the oil tank, the doorway including:

an access door opening and closing across the doorway, the access door permitting access to the oil fill spout when the access door is open, the access door restricting access to the oil fill spout when the access door is closed;

a safety cap having a top panel and a perimeter wall being attached to and extending downwardly from the top panel, the safety cap fitting over the oil cap and at least a portion of the oil fill spout;

a locking pin being attached to the top panel;

the top panel having a first locking pin aperture extending therethrough, the first locking pin aperture being configured to receive the locking pin;

an attachment mechanism being attached to the oil fill spout, the attachment mechanism configured to secure the safety cap over the oil cap and the oil fill spout, the attachment mechanism comprising:

a first clamp half being removably attached to a second clamp half, each of the first and second clamp halves being configured to extend halfway around a circumference of the oil fill spout; and the second clamp half having a second locking pin aperture extending therethrough, the second locking pin aperture being configured to receive the locking pin;

the first locking pin aperture and the second locking pin aperture being alignable when the safety cap is positioned on the oil fill spout so that the locking pin is extendable through both of the first and the second locking pin apertures, whereby the locking pin secures the safety cap to the attachment mechanism.

2. The oil safety cap system of claim 1, the attachment mechanism further comprising a pair of clamp screws securing the first clamp half to the second clamp half.

3. The oil safety cap system of claim 2, wherein the pair of clamp screws are laterally displaced with respect to each other across the first and second clamp halves.

4. The oil safety cap system of claim 1, the oil safety cap further comprising a door lanyard having a cap section and a door section, the cap section being attached to the safety cap.

5. The oil safety cap system of claim 4, the door lanyard further comprising a door tab being attached to the door section, the door tab being releasably coupled to the access door.

6. The oil safety cap system of claim 1, the oil safety cap further comprising a locking pin lanyard being attached to the safety cap, the locking pin lanyard having a first portion and a second portion, the first portion being attached to the safety cap, the locking pin being attached to the second portion.

7. The oil safety cap system of claim 1, wherein the locking pin is configured to extend through the first and the second locking pin apertures.

8. The oil safety cap system of claim 1, the locking pin further comprising a top portion and a bottom portion.

9. The oil safety cap system of claim 8, wherein the top portion has a top diameter, and wherein the bottom portion has a bottom diameter, and wherein the top diameter being larger than the bottom diameter.

10. The oil safety cap system of claim 9, wherein the bottom diameter is configured to fit within the first and the second locking pin apertures.

11. The oil safety cap system of claim 8, the locking pin further comprising a first spring-loaded ball bearing and a second spring-loaded ball bearing, wherein the first and the second spring loaded ball bearings are laterally displaced with respect to one another across the bottom portion.

12. The oil safety cap system of claim 11, wherein the locking pin is configured to extend through the first and second locking pin apertures, the top portion extending upwardly from the first locking pin aperture and the bottom portion extending downwardly from the second locking pin aperture, the first and second spring-loaded ball bearings being positioned below the second clamp half, a tension on each of the first and second spring-loaded ball bearings being released such that each of the first and second spring-loaded ball bearings extend outwardly from the locking pin, the first and second spring-loaded ball bearings securing a position of the locking pin within the first and second locking pin apertures.

13. An oil safety cap system comprising:

an oil fill spout being housed within an oil tank of a jet engine;

a doorway being positioned on the jet engine, the doorway being configured to permit access to the oil tank, the doorway including:

an access door opening and closing across the doorway, whereby the access door permits access to the oil fill spout when the access door is open, and whereby the access door restricts access to the oil fill spout when the access door is closed;

a door pin being attached to the access door, the door pin extending outwardly from the access door;

the oil fill spout having an opening therein;

an oil cap being configured to cover the opening;

a safety cap having a top panel and a perimeter wall being attached to and extending downwardly from the top panel, the safety cap fitting over the oil cap and at least a portion of the oil fill spout;

a locking pin being attached to the safety cap;

the top panel having a first locking pin aperture extending therethrough, the first locking pin aperture being configured to receive the locking pin;

a door lanyard having a cap section and a door section, the cap section being attached to the safety cap;

a door tab being attached to the door section, the door tab being releasably coupled to the door pin;

a locking pin lanyard having a first portion and a second portion, the first portion being attached to the safety cap;

the locking pin being secured to the second portion;

an attachment mechanism being attached to the oil fill spout, the attachment mechanism being configured to secure the safety cap over the oil fill spout and the oil cap, the attachment mechanism comprising:

a first clamp half and a second clamp half being configured to extend around a circumference of the oil fill spout, the first clamp half and the second clamp half being laterally displaced with respect to one another across the oil fill spout;

a pair of clamp screws being inserted through the first clamp half and the second clamp half, the pair of clamp screws being configured to securely attach the first clamp half to the second clamp half around the oil fill spout, the pair of clamp screws being laterally displaced with respect to each other across the first and second clamp halves;

the second clamp half having a second locking pin aperture extending therethrough, the second locking pin aperture being configured to receive the locking pin;

the first locking pin aperture and the second locking pin aperture being alignable when the safety cap is positioned on the oil fill spout so that the locking pin is extendable through both of the first and the second locking pin apertures, whereby the locking pin secures the safety cap to the attachment mechanism;

the locking pin having a top portion and a bottom portion, the top portion having a top diameter, the bottom portion having a bottom diameter, the top diameter being larger than the bottom diameter, the bottom diameter being configured to fit within the first and the second locking pin apertures;

a pair of spring-loaded ball bearings being laterally displaced across the bottom portion; and the locking pin being configured to extend through the first and second locking pin apertures, the top portion extending upwardly from the first locking pin aperture and the bottom portion extending downwardly from the second locking pin aperture such that each of the pair of spring-loaded ball bearings is below the second clamp half and a tension on the pair of spring-loaded ball bearings is released to secure a position of the locking pin within the first and second locking pin apertures.

* * * * *